US005899838A

United States Patent [19]

Jacobs

[11] Patent Number: 5,899,838

[45] Date of Patent: May 4, 1999

[54] COMBINED EXERCISE AND FURNITURE DEVICE

[76] Inventor: Lawrence I. Jacobs, P.O. Box 1667, Newport Beach, Calif. 92663

[21] Appl. No.: 08/974,786

[22] Filed: Nov. 20, 1997

[51] Int. Cl.[6] ..... A63B 26/00; A61G 15/00

[52] U.S. Cl. ..... 482/142; 482/23; 128/845

[58] Field of Search ..... 482/23, 140, 142, 482/104, 130, 132; 606/240; D24/190–191; D6/596, 593, 599, 601; 5/621, 622, 624, 633, 648, 722, 723; 297/440.1, 92, 283.2; 128/845

[56] References Cited

U.S. PATENT DOCUMENTS

| | | | |
|---|---|---|---|
| D. 91,262 | 1/1934 | Barcalo . | |
| D. 215,536 | 10/1969 | Larsen . | |
| D. 236,062 | 7/1975 | Winston . | |
| D. 246,816 | 1/1978 | Tam et al. . | |
| D. 247,209 | 2/1978 | Woog . | |
| D. 273,915 | 5/1984 | Pike . | |
| D. 288,632 | 3/1987 | Grimsrud . | |
| D. 289,354 | 4/1987 | Willey . | |
| D. 317,840 | 7/1991 | Jagdat . | |
| D. 327,198 | 6/1992 | Erker, Jr. et al. . | |
| D. 353,173 | 12/1994 | Almeda . | |
| D. 355,004 | 1/1995 | Hanning, Jr. . | |
| D. 356,919 | 4/1995 | Nadeau | D6/601 |
| D. 364,202 | 11/1995 | Benson . | |
| 3,624,848 | 12/1971 | Nissen | 5/420 |
| 3,939,296 | 2/1976 | Weiss | 312/111 |
| 4,171,549 | 10/1979 | Morrell et al. | 5/632 |
| 4,473,913 | 10/1984 | Ylisaker . | |
| 4,635,306 | 1/1987 | Willey . | |
| 4,770,466 | 9/1988 | Pesterfield . | |
| 4,780,921 | 11/1988 | Lahn et al. . | |
| 4,905,330 | 3/1990 | Jacobs . | |
| 5,474,509 | 12/1995 | Hodgdon . | |
| 5,474,513 | 12/1995 | Carlesimo et al. . | |

*Primary Examiner*—Richard J. Apley
*Assistant Examiner*—Denise Pothier
*Attorney, Agent, or Firm*—Zarley,McKee, Thomte, Voorhees & Sease

[57] ABSTRACT

Each of the cushions in a pair of cushions has two flat sides which meet at a right angle corner and a convex side which interconnects the free ends of the two flat sides. The two cushions may be arranged in a wide variety of end-to-end positions to allow the exerciser to assume various postures. The cushions may be turned on their side and arranged with corresponding flat sides partially overlapping to form separated leg spaces for two people to sit on the cushions in a face-to-face relationship.

9 Claims, 4 Drawing Sheets

COMBINED EXERCISE AND FURNITURE DEVICE

BACKGROUND OF THE INVENTION

I have previously designed a combined exercise and furniture device as shown in my U.S. Pat. No. 4,905,330, Mar. 6, 1990. This unit included interconnected rectangular and wedge-shaped sections which could be arranged in a number of different positions to provide various exercise and furniture possibilities All of the surfaces in this unit were flat. While this product has been successful, it nevertheless has limitations in providing certain postures for the exerciser. These limitations in part are due to the use of all flat sides on the interconnected sections.

An alternate multiple cushion type device is shown in U.S. Pat. 4,635,306, Jan. 13, 1987. All surfaces on the cushions are flats and thus limit the possible configurations of use and the postures that may be assumed by the user.

Thus, what is needed is a multiple cushion type exercise device that will allow for a wider range of posture positions for the exercisers including being used as furniture.

SUMMARY OF THE INVENTION

The combined exercise and furniture device includes a pair of cushions each of which have two flat sides which are interconnected by a convex outwardly sides. The opposite ends of the flat sides meet at a right angle corners. The flat sides of each cushion have a different length, while the corresponding sides of each cushion may have the same length or different lengths.

When the cushions are being used by passive exercise postures, the cushions are aligned in an end-to-end relationship presenting either a convex upwardly support surface for the exerciser or a generally V-shaped supports. Spacing may be added between the cushions to provide a flattened center area between the oppositely disposed convex surfaces.

When the cushions are arranged to provide a convex support surfaces a handle may be provided by positioning a rod in aligned sleeves on each of the cushions at their adjacent upper corner edges. Cords are connected to the opposite ends of the rods and are accessible by the exerciser to be used to return to an upright position.

The cushions may be used as furniture by turning them on one of their oppositely disposed parallel sides and partially overlapping flat sides of the cushions. This arrangement creates notched out right angle leg spaces for two people. In this arrangements two people can substantially face each other while sitting on separate cushions and their legs being separated by the cushions.

DETAILED DESCRIPTION OF THE INVENTION

Figure 1:
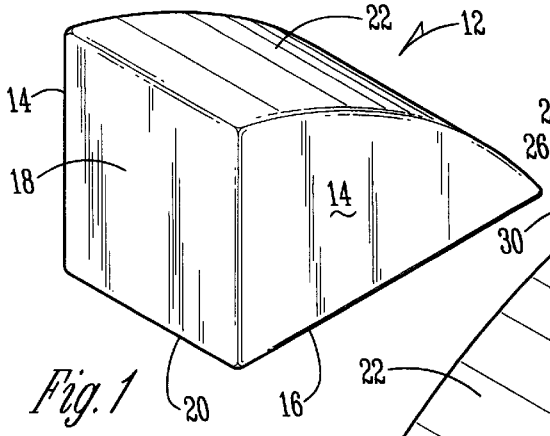
FIG. 1 is a perspective view of one of the cushions used in the two-cushion combined exercise and furniture device.
Figure 2:
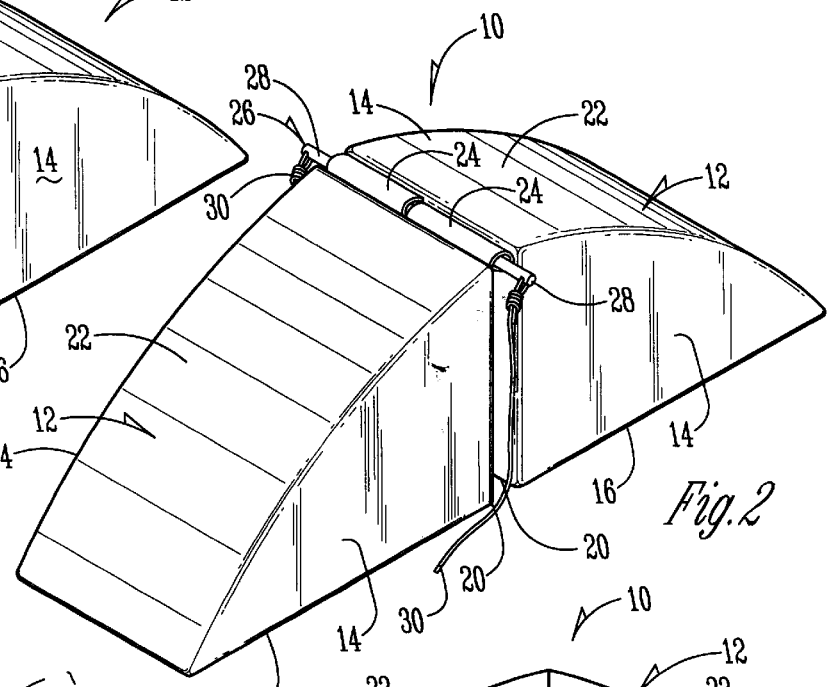
FIG. 2 is a perspective view of the two cushions arranged in end-to-end relationship with their convex surfaces facing upwardly to provide a continuous radius support.
Figures 10, 11, 12:
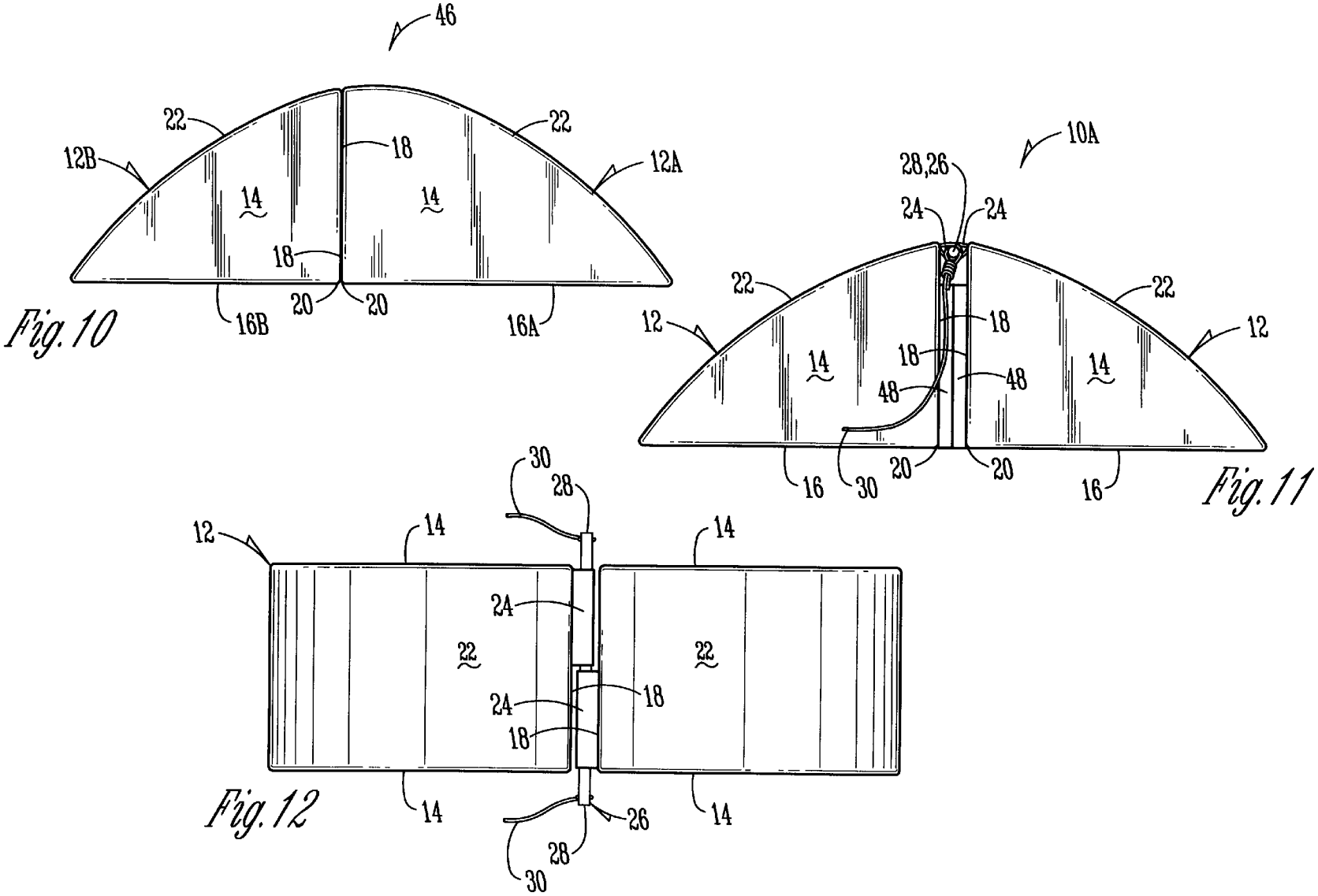
FIG. 10 is a side elevational view of an alternate embodiment similar to that shown in FIGS. 2 and 2A but with the long side of one cushion being longer than the corresponding side of the other cushion.
FIG. 11 is a side view of the embodiment of FIGS. 2 and 2A showing a pair of spacer pads being positioned between the cushions to provide a flattened central area in the generally rounded convex supporting surface.
FIG. 12 is a top plan view thereof showing the cushions being interconnected by a rod extending through sleeves aligned on each of the cushions.

One embodiment of the combined exercise and furniture device of this invention is referred to in FIG. 2 generally by the reference numeral 10. This embodiment includes a pair of identically shaped cushion units 12 as shown in FIG. 1. Each of the units have opposite parallel flat sides 14. The other three sides include a pair of flat sides, one of which 16 is longer than the other 18. Flat sides 16 and 18 meet at adjacent ends to form a right angle corner 20 and are interconnected at their free ends by a convex side 22. The flat sides 18 include at their upper ends aligned sleeves 24 as best seen in FIG. 12 which receive a rod 26 having outer end handle portions 28. The rod includes at opposite ends a pair of cords 30 which extend downwardly to be accessible by a person positioned on the rounded top supporting surface formed by the convex sides 22 of the two cushions 12. Use of the ropes 30 will allow the exerciser to pull him or herself to an upright position. Rod 26 is positioned between the flat sides 18, and thus bear against these sides when being pulled upon.

Figure 3:
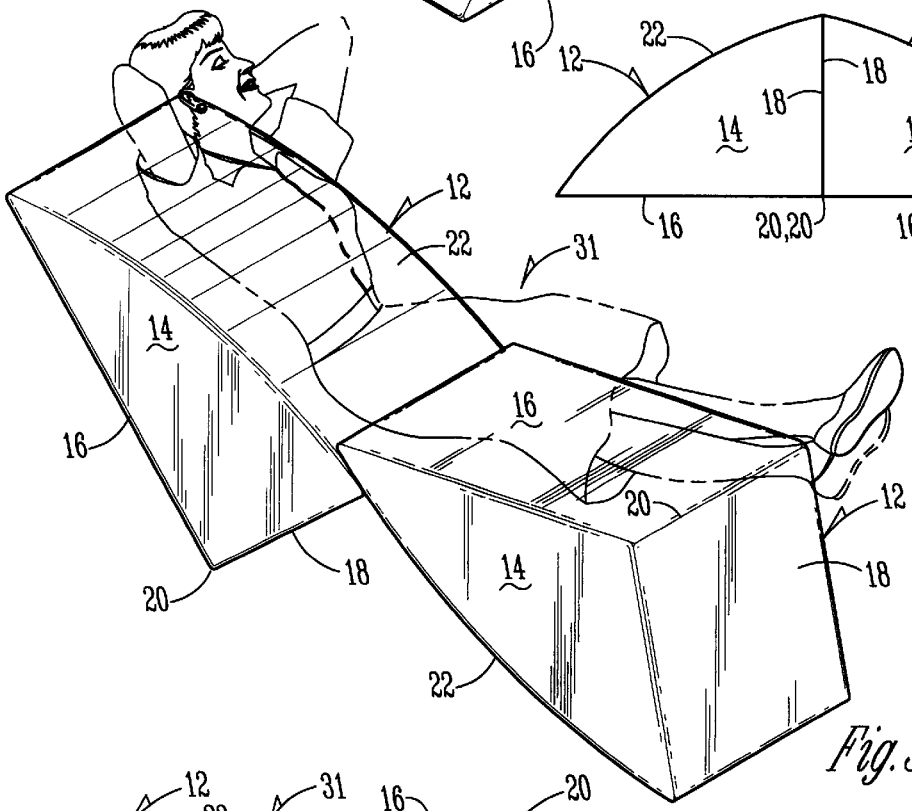
FIG. 3 is a perspective view of the two cushions arranged with one having its convex surface facing downwardly and the other facing upwardly while the adjacent ends of the cushions overlap each other.
Figure 3A:
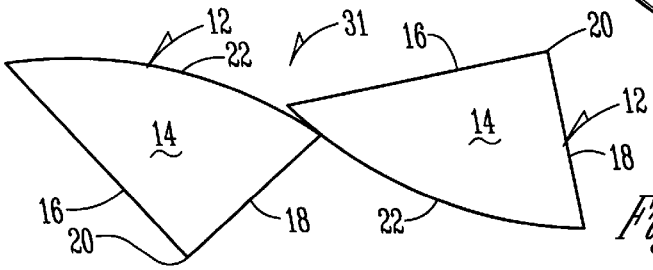
FIG. 3A is a side elevational view thereof.

In FIGS. 3 and 3A another arrangement of the pair of cushions 12 is shown and is generally referred to by the reference numeral 31. The cushions 12 are arranged in end-to-end relationship with the convex surface 22 of one cushion facing downwardly while the corresponding convex surface 22 of the other cushion faces upwardly. In this arrangement the convex surfaces 22 of each of the cushions face each other in a partially overlapping relationship which allows the cushions to be relatively rockable as a person on the cushion moves his or her body weight. The cushion 12 having its convex side facing upwardly engages the floor through the corner 20 while the other cushion is free to rock on the convex surface 22 which is engaging the floor. The upper flat surface 16 and the convex surface 22 cooperate to form a generally V-shaped upwardly facing support surface for the user.

Figure 4A:
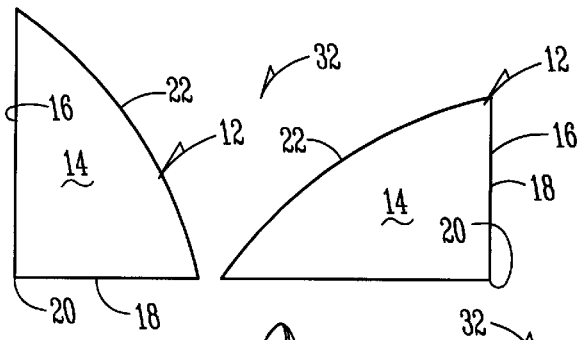
FIG. 4A is a side elevational view thereof.
Figure 4:
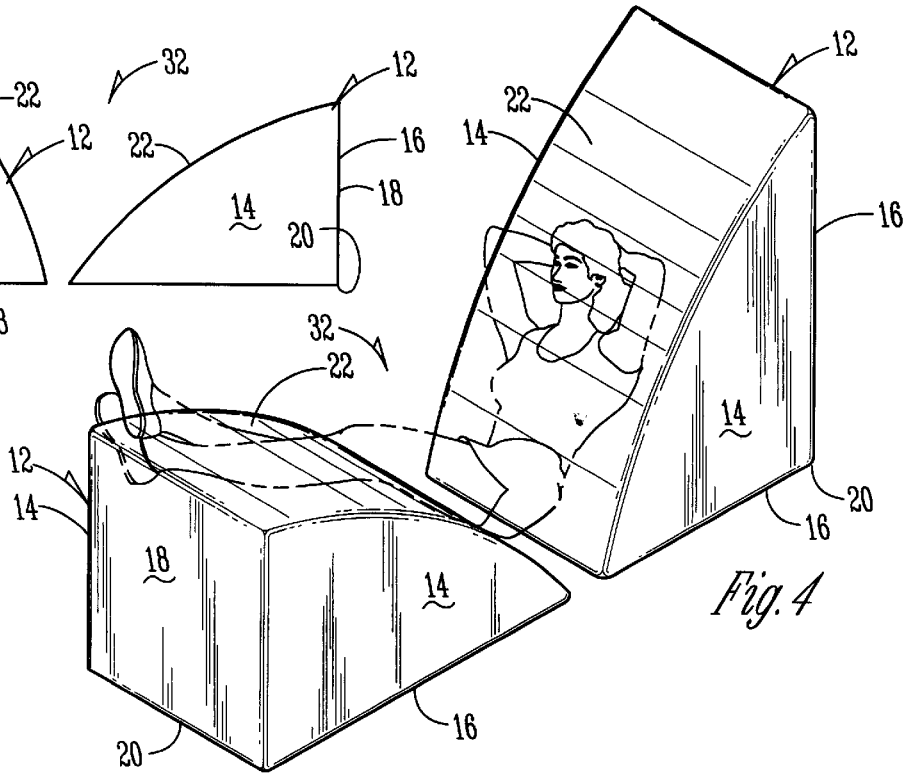
FIG. 4 is a perspective view of the two cushions arranged end to end with the convex surfaces facing upwardly and towards each other while the long flat side of one cushion faces downwardly and the short flat side of the other cushion faces downwardly.

The arrangement shown in FIGS. 4 and 4A is generally referred to by the reference numeral 32 and while providing a generally V-shaped support surface for the user does so by both cushion convex surfaces 22 facing upwardly and the longer flat sides 16 facing downwardly engaging the floor.

It is seen that different postures can be assumed by the exerciser as desired through appropriate positioning of the cushions 12 in various end-to-end relationships.

Figure 5A:
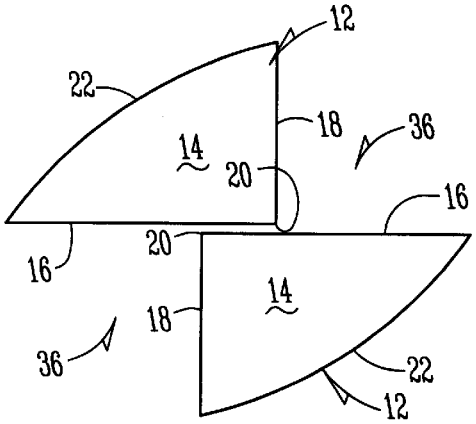
FIG. 5A is a top plan view thereof.
Figure 5:
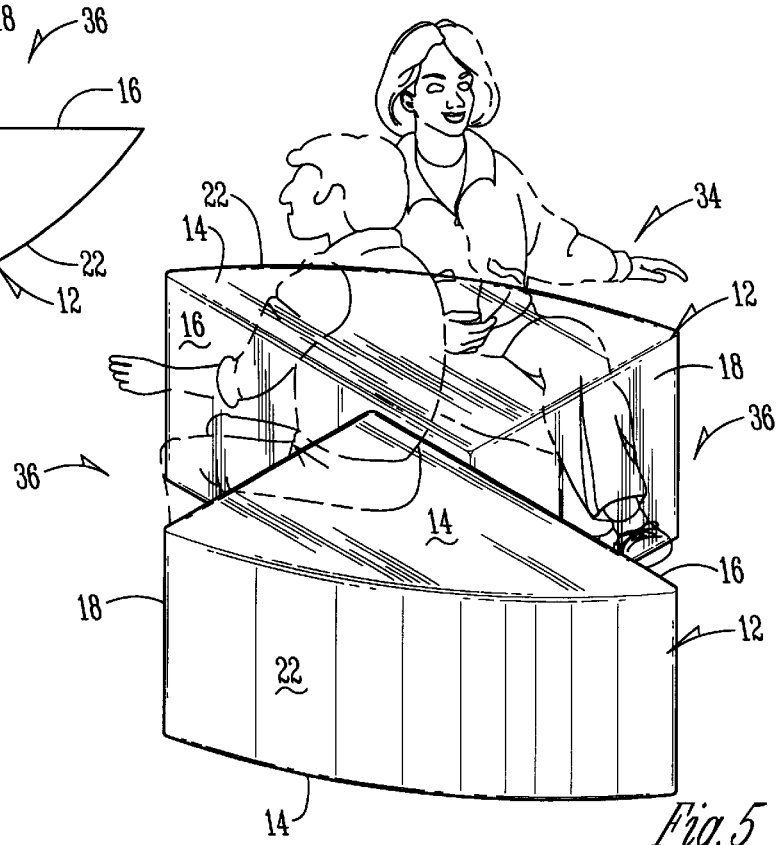
FIG. 5 is a perspective view of the cushions arranged on their sides to provide a seating configuration with each of two people having separate right angle leg space while sitting in a generally facing relationship.

In FIGS. 5 and 5A the cushions 12 are turned on their sides to provide a furniture piece generally referred to by the reference numeral 34. In this arrangement, the long flat sides 16 are in partially overlapping relationship to form separate right angle leg spaces 36 for persons sitting on the sides 14 in a generally face-to-face relationship.

Figure 6:
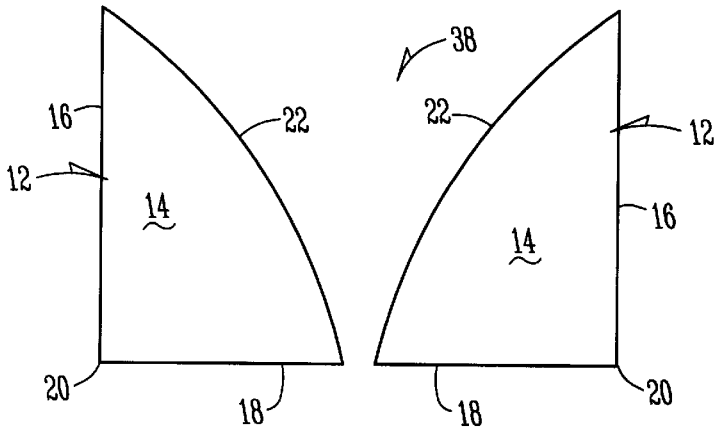
FIG. 6 is a side elevational view of the cushions arranged with the convex surfaces facing upwardly and towards each other and flat surfaces of equal length on each cushion facing downwardly.

The arrangement in FIG. 6 is referred to generally by the reference numeral 38 and is generally similar to that in FIG. 4. The difference between the two arrangements is that in FIG. 6 the short sides 18 face downwardly and engage the floor. This presents a sharper V-shaped user support surface formed by the upwardly facing convex sides 22.

Figure 2A:
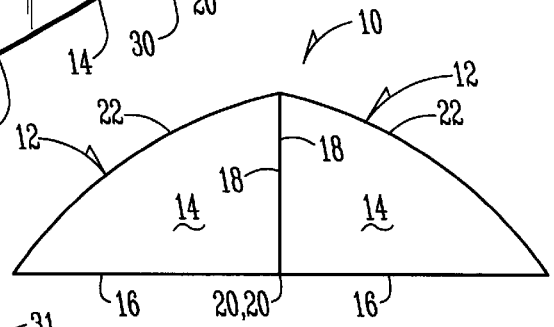
FIG. 2A is a side elevational view thereof.
Figure 7:
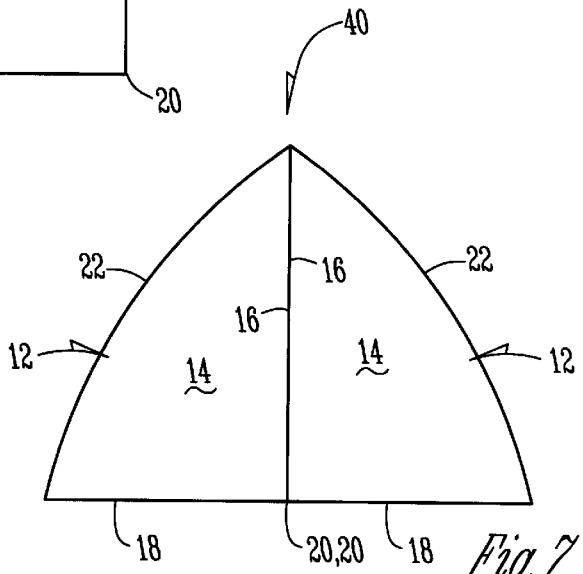
FIG. 7 is an elevational view of the cushions arranged in back-to-back relationship with the convex surfaces facing upwardly and outwardly to form a rounded arch as a support surface.

The arrangement in FIG. 7 is referred to generally by the reference numeral 40 and is similar to that shown in FIGS. 2 and 2A except that the short flat surfaces 18 engage the floor thereby presenting a sharper rounded support surface for the user through the end-to-end positioning of the convex surfaces 22.

Figure 8:
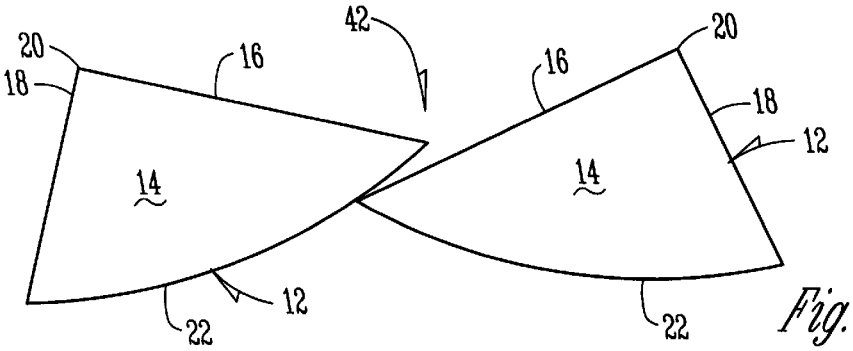
FIG. 8 is a side elevational view showing the cushions arranged in overlapping end-to-end aligned relationship with the convex surfaces facing downwardly.

In FIG. 8, the cushions 12 are arranged in yet a different relationship generally referred to by the reference numeral 42 wherein both convex surfaces 22 face downwardly for engagement with the floor with the longer flat surface 16 of one of the cushions extending under the other cushion and engaging the convex surface 22. A generally V-shaped support surface for the user is formed by the end-to-end flat sides 16. It is seen that the cushions are free to rock as the user shifts weight.

Figure 9:
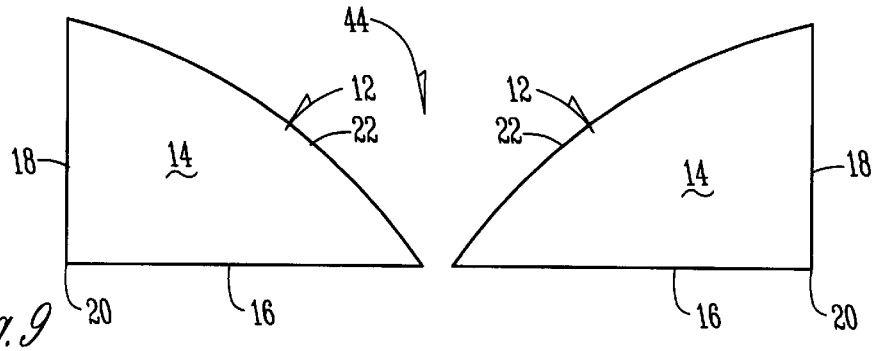
FIG. 9 is a side elevational view of the cushions arranged in end-to-end relationship similar to that in FIG. 6 but with the long flat sides of each of the cushions facing downwardly.

The arrangement in FIG. 9 generally referred to by the reference numeral 44 is similar to that in FIG. 6 except that the long flat sides 16 engage the floor, thus presenting a more gentle upwardly facing V-shaped user support surface formed by the convex surfaces being in end-to-end relationship.

In FIG. 10 an alternate embodiment generally referred to by the reference numeral 46 is shown similar to that in FIGS. 2 and 2A except that the individual cushions 12A and 12B have their longer flat surfaces 16A and 16B of different lengths. The cushions 12A and 12B can be arranged in any of the previously discussed relationships, but in doing so there will be greater variations in the postures that may be achieved by the user.

The arrangement of the cushions 12 in FIG. 11 generally referred to by the reference numeral 10A is similar to that in FIGS. 2 and 2A except that one or more pads 48 are placed between the cushions to form a generally flattened center area between the convex surfaces 22. It is seen that the rod 26 and sleeves 24 are positioned on top of the pads 48, but yet between the cushions against the flat sides 18.

It is thus seen that a wide variety of different arrangements are possible through selective positioning of the pair of cushions. Common to all configurations is the flexibility allowed by each cushion having two flat sides meeting at a right angle corner with free ends interconnected by a convex side. The lengths of the flat sides may vary as the user requires for a particular posture that is desired.

What is claimed is:

1. A combined exercise and furniture device comprising, a pair of cushions positioned in side-by-side relationship, each of said cushions having a pair of opposite parallel flat sides between which said cushion is defined by three sides, said first and second of said three sides being flat and meeting at a right angle corner, and said third side being convex outwardly and interconnecting said first and second sides, and each of said cushions includes a longitudinal sleeve, said sleeve of one of the pair of cushions aligned with said sleeve of the other of the pair of cushions, the device further comprising a rod, the rod received into the aligned sleeves for interconnecting said pair of cushions and providing handle means for persons supported on said cushions.

2. The combined exercise and furniture device of claim 1 wherein one of said first and second flat sides of each of said pair of cushions are in substantial abutting aligned engagement to provide an upwardly facing continuously rounded convex body supporting surface.

3. The combined exercise and furniture device of claim 1 wherein said rod includes rope portions extending from opposite ends thereof for being held by persons supported in a reclining posture on said cushions to pull themselves to an upright posture.

4. The combined exercise and furniture device of claim 1 wherein said first and second flat sides of one cushion has the same length as the corresponding first and second flat sides of the other cushion.

5. The combined exercise and furniture device of claim 1 wherein one of said first and second flat sides of one of said cushions has the same length as the corresponding one side of said first and second flat sides of the other cushion, and the other side of said first and second flat sides of both cushions have different lengths.

6. The combined exercise and furniture device of claim 1 wherein one of said first and second flat sides of each of said pair of cushions are in substantial abutting aligned engagement to provide an upwardly facing rounded convex body supporting surface.

7. The combined exercise and furniture device of claim 6 and spacing means is provided between said pair of cushions to provide a substantially flat body support surface area.

8. The combined exercise and furniture device of claim 1 wherein each of said side-by-side sides have adjacent top and bottom edges, and said sleeves on each of said cushions is positioned on said top edge.

9. The combined exercise and furniture device of claim 1 wherein said sleeves and rod are positioned between said cushions and are adopted to bear against one or the other of said adjacent side-by-side sides when persons pull themselves up using said rod.

* * * * *